US011453998B2

(12) United States Patent
Kimura et al.

(10) Patent No.: US 11,453,998 B2
(45) Date of Patent: Sep. 27, 2022

(54) EXHAUST MECHANISM AND WORKING VEHICLE

(71) Applicant: Kubota Corporation, Osaka (JP)

(72) Inventors: Taketo Kimura, Sakai (JP); Yusuke Hada, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 1 day.

(21) Appl. No.: 17/225,104

(22) Filed: Apr. 8, 2021

(65) Prior Publication Data

US 2022/0034065 A1 Feb. 3, 2022

(30) Foreign Application Priority Data

Aug. 3, 2020 (JP) ..... JP2020-131699

(51) Int. Cl.
*E02F 9/08* (2006.01)
*F01N 13/08* (2010.01)
*F01N 13/18* (2010.01)

(52) U.S. Cl.
CPC ..... *E02F 9/0866* (2013.01); *F01N 13/082* (2013.01); *F01N 13/1822* (2013.01); *F01N 2590/08* (2013.01)

(58) Field of Classification Search
CPC .. F01N 13/082; F01N 13/085; F01N 13/1822; F01N 2240/20; F01N 2470/10; F01N 2590/08
See application file for complete search history.

(56) References Cited

U.S. PATENT DOCUMENTS 4,964,383 A * 10/1990 Shinno ..... F02B 61/00 123/195 C
2019/0136739 A1* 5/2019 Muramatsu ..... F01N 1/166

FOREIGN PATENT DOCUMENTS

| | | | | |
|---|---|---|---|---|
| JP | 10-305736 | | 11/1998 | |
| JP | 2003313901 | A * | 11/2003 | ..... F01N 13/082 |
| JP | 2010-248691 | | 11/2010 | |
| JP | 6286338 | B2 | 5/2016 | |
| JP | 6383234 | B2 | 5/2016 | |
| JP | 6400520 | B2 | 11/2016 | |
| JP | 2017-053255 | | 3/2017 | |
| JP | 2018-204430 | | 12/2018 | |
| JP | 2020-007907 | | 1/2020 | |

* cited by examiner

*Primary Examiner* — Anthony Ayala Delgado
(74) *Attorney, Agent, or Firm* — Mori & Ward, LLP

(57) ABSTRACT

An exhaust mechanism includes an exhaust pipe, an exhaust port, and a baffle plate. The exhaust pipe has one end connected to an engine and another end opposite to the one end along a length of the exhaust pipe. The exhaust port is provided at another end of the exhaust pipe and extends in a first direction inclined from the height direction along a height of the work vehicle. A length of the exhaust port in the height direction is shorter than a length of the exhaust port in the transverse direction perpendicular to a plane including the first direction and the height direction. The baffle plate is provided in the exhaust port and configured to change an exhaust gas flow from the first direction to the transverse direction.

8 Claims, 10 Drawing Sheets

EXHAUST MECHANISM AND WORKING VEHICLE

CROSS-REFERENCE TO RELATED APPLICATIONS

The present application claims priority under 35 U.S.C. § 119 to Japanese Patent Application No. 2020-131699, filed Aug. 3, 2020. The contents of this application are incorporated herein by reference in their entirety.

BACKGROUND OF THE INVENTION

Field of the Invention

The present invention relates to an exhaust mechanism provided in a work vehicle and a working vehicle.

Discussion of the Background

Japanese Patent Laid-Open Publication No. 2010-248691 discloses an exhaust mechanism in which a skewed plate capable of changing an exhaust direction in which exhaust gas is discharged from an exhaust port to outside air upward is provided in a bent cylinder of an exhaust tail pipe in order to adjust the exhaust direction according to a specification of a construction machine or a working environment or the like. Japanese Patent No. 6400520 discloses an exhaust mechanism provided in a work vehicle having an openable and closable cabin.

SUMMARY OF THE INVENTION

According to one aspect of the present disclosure, an exhaust mechanism includes an exhaust pipe, an exhaust port, and a baffle plate. The exhaust pipe has one end connected to an engine and another end opposite to the one end along a length of the exhaust pipe. The exhaust port is provided at another end of the exhaust pipe and extends in a first direction inclined from the height direction along a height of the work vehicle. A length of the exhaust port in the height direction is shorter than a length of the exhaust port in the transverse direction perpendicular to a plane including the first direction and the height direction. The baffle plate is provided in the exhaust port and configured to change an exhaust gas flow from the first direction to the transverse direction.

According to another aspect of the present disclosure, a work vehicle includes an exhaust mechanism according to the one aspect, a heat exchanger to cool a refrigerant, a cover covering the heat exchanger, an air suction port provided on the upper surface of the cover, and a fan to send air from the air suction port to the heat exchanger. The exhaust port faces the air suction port.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
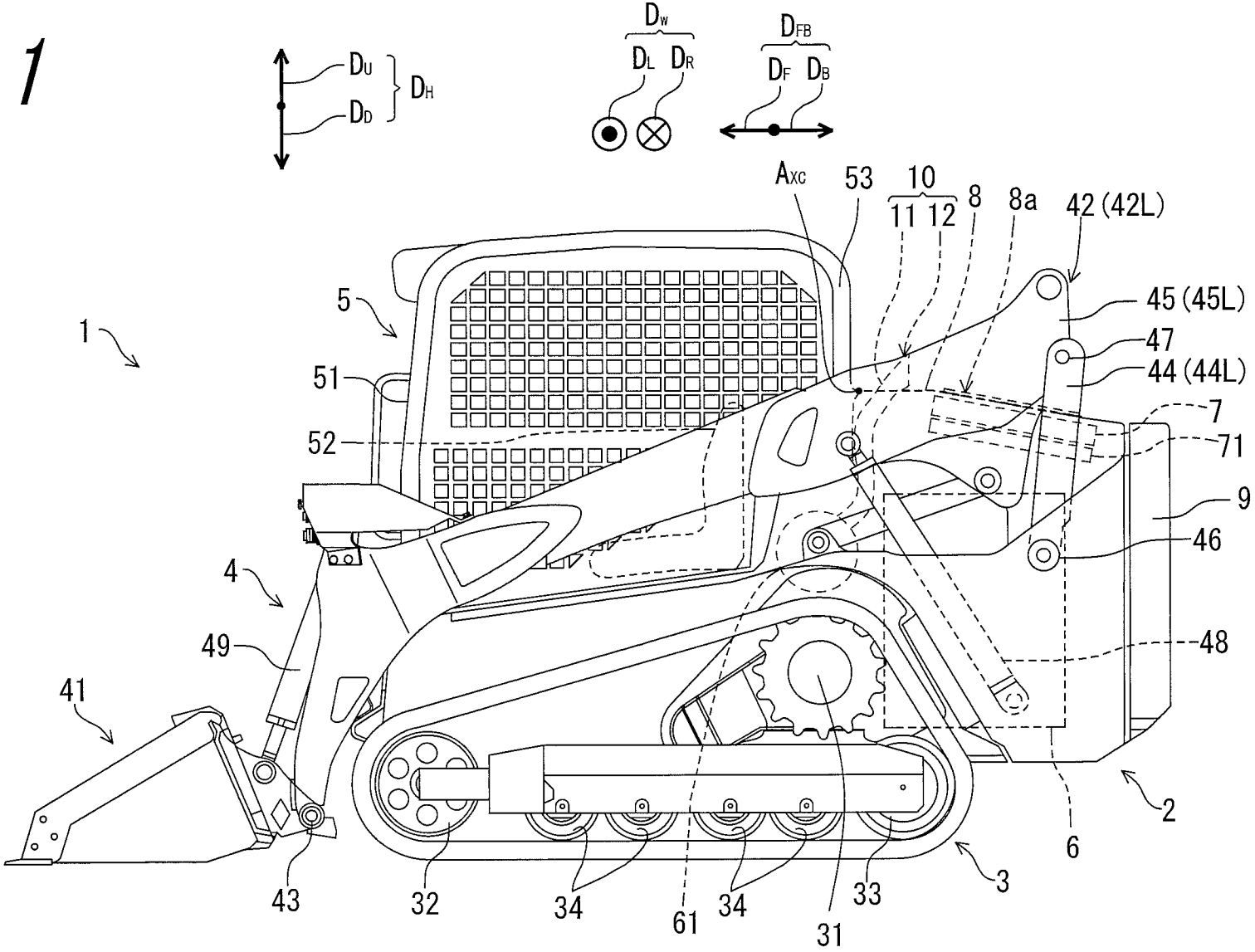
FIG. 1 is a side view of a work vehicle.

The embodiments will now be described with reference to the accompanying drawings, wherein like reference numerals designate corresponding or identical elements throughout the various drawings.

Hereinafter, the present invention will be specifically described with reference to the drawings showing embodiments thereof. In the drawings, like reference numerals denote corresponding or substantially identical configurations.

Embodiment

<Overall Composition>

Figure 2:
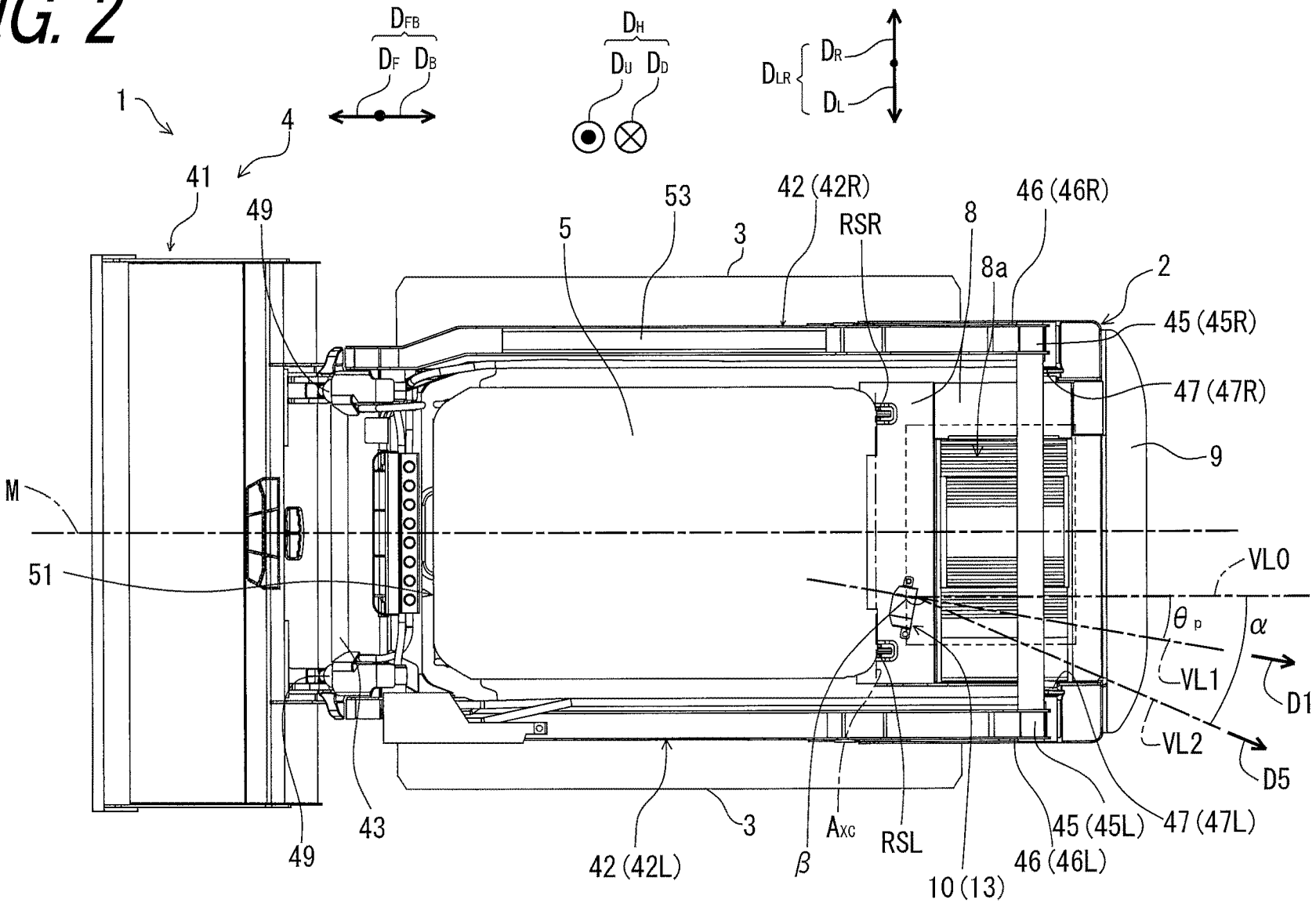
FIG. 2 is a top view of a work vehicle.
Figure 3:
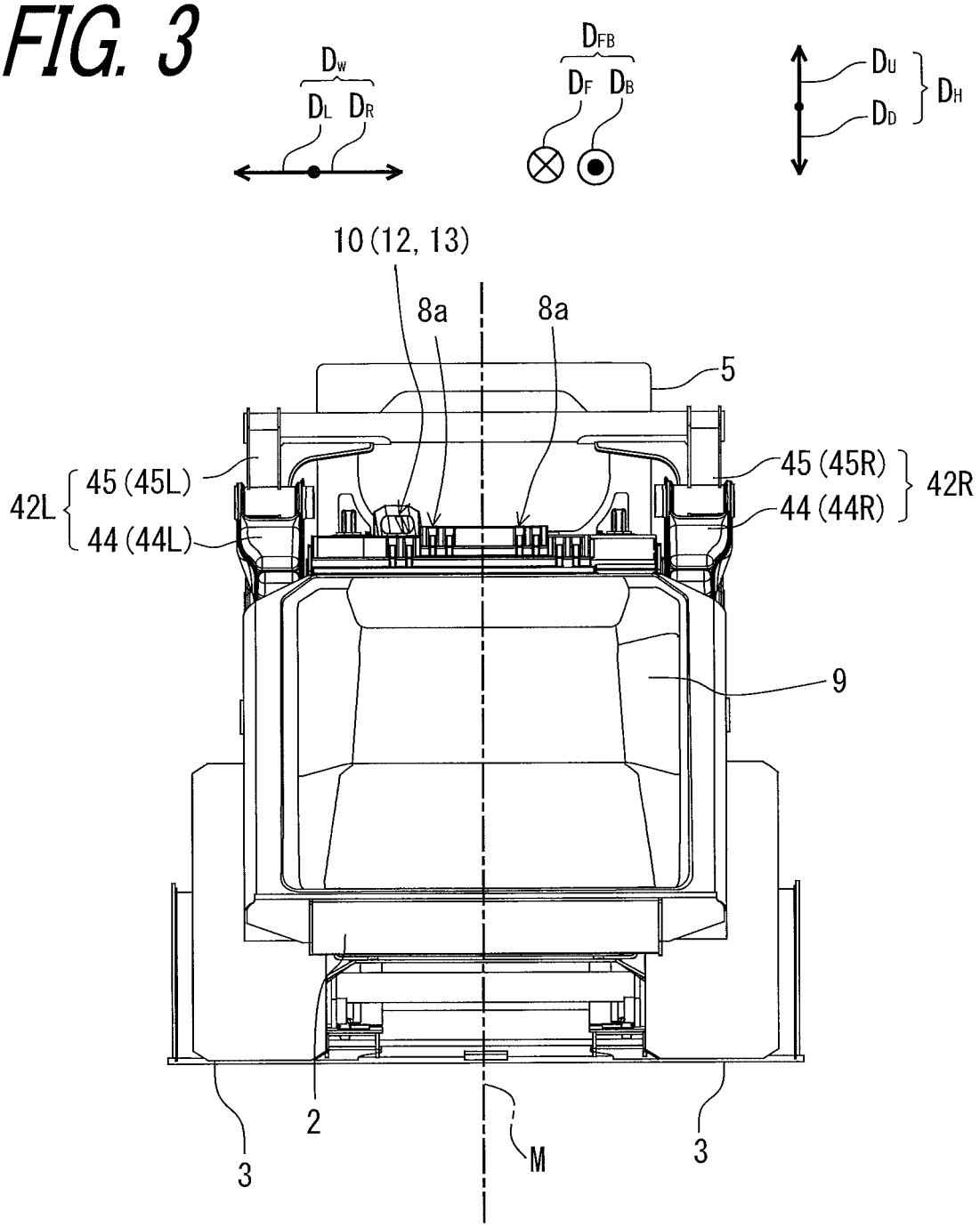
FIG. 3 is a rear view of the work vehicle.

Referring to FIGS. 1-3, work vehicle 1, such as a compact track loader, includes an exhaust mechanism 10. A work vehicle 1 includes a vehicle body frame 2, a traveling device 3, a working device 4, and a cabin 5. The vehicle body frame 2 supports the traveling device 3, the working device 4, and the cabin 5. In the illustrated embodiment, the traveling device 3 is a crawler type traveling device. Therefore, the traveling device 3 includes a driving wheel 31, driven wheels 32 and 33, and a roller 34. However, the traveling device 3 is not limited to a crawler type traveling device. The traveling device 3 may be, for example, a front-wheel/rear-wheel traveling device or a traveling device having a front wheel and a rear crawler. The working device 4 includes a work equipment (bucket) 41 at the distal end of the working device 4. The proximal end of the working device 4 is attached to the rear part of the vehicle body frame 2. The working device 4 includes a pair of arms 42 for rotatably supporting the bucket 41 through a bucket pivot shaft 43. Each of the pair of arms 42 includes a lift link 44 and a boom 45.

The lift link 44 is rotatable about the fulcrum shaft 46 relative to the vehicle body frame 2. The boom 45 is rotatable about the joint shaft 47 relative to the lift link 44. The working device 4 further includes a plurality of boom cylinders 48 and at least one equipment cylinder 49. Each of the plurality of boom cylinders 48 is rotatably connected to the vehicle body frame 2 and the boom 45 and moves the lift link 44 and the boom 45 to raise and lower the bucket 41. At least one equipment cylinder 49 is configured to tilt the bucket 41. The cabin 5 is attached to the front part of the vehicle body frame 2. The work vehicle 1 includes a front door 51 in front of a cabin 5, and a driver's seat 52 and an operation device (Not shown) in the cabin 5. The interior space of the cabin 5 is defined by a cab frame 53. As shown in FIG. 2, the cab frame 53 is rotatable about rotation axes RSL and RSR on the vehicle body frame 2. In FIGS. 1 and 2, a common rotational axis $A_{XC}$ defined by rotation shafts RSL and RSR is illustrated.

In the embodiment according to the present application, the front-rear direction $D_{FB}$ (forward $D_F$/backward $D_B$) means the front-rear direction (forward/backward) as viewed from an operator sitting on the driver's seat 52 of the cabin 5. The left direction $D_L$, the right direction $D_R$, and the width direction $D_W$ mean the left direction, the right direction, the left direction, and right direction, respectively, as viewed from the operator. The upward direction $D_U$, the downward direction $D_D$, and the height direction $D_H$ mean the upward direction, the downward direction, and the height direction when viewed from the operator. The front-rear/right-left (width)/up-down (height) directions of the work vehicle 1 correspond to the front-rear/left-right (width)/up-down (height) directions viewed from the operator.

In FIG. 1, one of the pair of arms 42 is provided on the left side of the cabin 5. The other of the pair of arms 42 is provided on the right side of the cabin 5. More specifically, one of the boom cylinders 48 and one of the booms 45 is provided on the left side of the cabin 5. Another of the boom cylinders 48 and another of the booms 45 are provided on the right side of the cabin 5. FIG. 1 shows the left side of the work vehicle 1. As shown in FIGS. 2 and 3, the vehicle body frame 2 is generally symmetrical with respect to the vehicle body center plane M, and an arm 42 provided on the left side with respect to the vehicle body center plane M of the pair of arms 42 is shown as a first arm 42L, and an arm 42 provided on the right side with respect to the vehicle body center plane M is shown as a second arm 42R. A lift link 44 provided on the left side of the vehicle body center plane M is shown as a first lift link 44L, and a lift link 44 provided on the right side of the vehicle body center plane M is shown as a second lift link 44R. A boom 45 provided on the left side of the vehicle body center plane M is shown as a first boom 45L, and a boom 45 provided on the right side of the vehicle body center plane M is shown as a second boom 45R. A fulcrum shaft 46 provided on the left side with respect to the vehicle body center plane M is shown as a first fulcrum shaft 46L, and a fulcrum shaft 46 provided on the right side with respect to the vehicle body center plane M is shown as a second fulcrum shaft 46R. A joint shaft 47 provided on the left side of the vehicle body center plane M is shown as a first joint shaft 47L, and a joint shaft 47 provided on the right side of the vehicle body center plane M is shown as a second joint shaft 47R.

Referring to FIG. 1, the work vehicle 1 further includes an engine 6 and a heat exchanger 7 provided at the rear of the vehicle body frame 2. The engine 6 is configured to provide driving force to the traveling device 3 and the working device 4. The heat exchanger 7 includes a radiator for cooling the refrigerant of the engine 6. Further preferably, the heat exchanger 7 includes an oil cooler configured to cool hydraulic fluid used in the hydraulic system (e.g., boom cylinder 48 and at least one equipment cylinder 49) of the work vehicle 1. The work vehicle 1 includes a fan 71 for air-cooling the heat exchanger 7. The engine 6 and the heat exchanger 7 are provided between the pair of arms 42 in the width direction $D_W$ of the work vehicle 1.

The work vehicle 1 further includes a cover 8 for covering the heat exchanger 7. The cover 8 further covers the engine 6. An air suction port 8*a* for taking air into the inside of the cover 8 is provided on the upper surface of the cover 8. The work vehicle 1 further includes a bonnet cover 9 provided at the rear end of the vehicle body frame 2. The bonnet cover 9 can be opened and closed, and a maintenance worker can perform maintenance work of the engine 6 or the like.

The exhaust mechanism 10 includes an exhaust pipe 11 whose one end is connected to the engine 6, and an exhaust port 12 connected to the exhaust pipe 11. More specifically, the exhaust pipe 11 is connected to the engine 6 through an exhaust treatment apparatus 61 for processing the exhaust of the engine 6. The exhaust treatment apparatus 61 includes, for example, a particulate removing filter. However, the exhaust treatment apparatus 61 may include a selective reduction catalyst apparatus. Referring to FIG. 2, the exhaust mechanism 10 is provided between the rotational shafts RSL and RSR and the air suction port 8*a* in the front-rear direction $D_{FB}$ of the vehicle body frame 2. The exhaust mechanism 10 is provided on the left side of the vehicle body center plane M. More specifically, the exhaust mechanism 10 is provided near the middle between the first arm 42L and the vehicle body center plane M in the width direction $D_W$ of the work vehicle 1.

Figure 4:
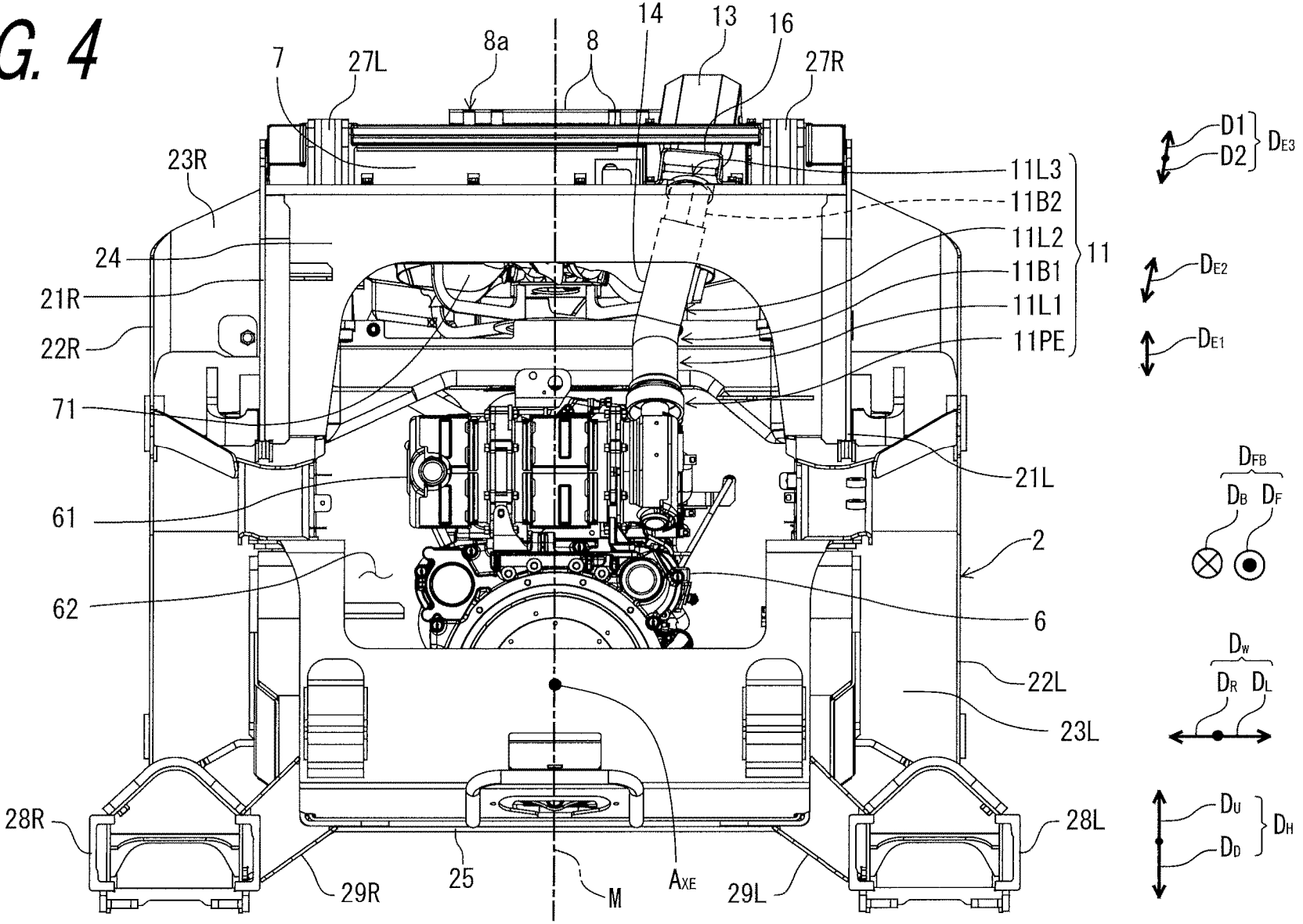
FIG. 4 is a view of a part of the work vehicle viewed from the front end toward the rear of the work vehicle.

FIG. 4 is a view showing a part of the work vehicle 1 viewed backward $D_B$ from the front end of the work vehicle 1. In FIG. 4, only the vehicle body frame 2, the engine 6, the exhaust treatment apparatus 61, the exhaust mechanism 10, the heat exchanger 7, the fan 71, and the cover 8 are omitted. Referring to FIG. 4, the vehicle body frame 2 includes a first inner wall 21L, a second inner wall 21R, a first outer wall 22L, a second outer wall 22R, a first rear wall 23L, a second rear wall 23R, an upper wall 24, a bottom wall 25, a first track frame 28L, a second track frame 28R, a first mounting frame 29L, and a second mounting frame 29R.

The first inner wall 21L and the second inner wall 21R connect the upper wall 24 and the bottom wall 25 and extend in the height direction $D_H$. The first outer wall 22L faces the first inner wall 21L in the width direction $D_W$ and extends in the height direction $D_H$. The second outer wall 22R faces the second inner wall 21R in the width direction $D_W$ and extends in the height direction $D_H$. The first inner wall 21L and the first outer wall 22L are positioned on the left side with respect to the vehicle body center plane M. The second inner wall 21R and the second outer wall 22R are positioned on the right side of the vehicle body center plane M. The first inner wall 21L is positioned between the first outer wall 22L and the vehicle body center plane M in the width direction $D_W$. The second inner wall 21R is positioned between the second outer wall 22R and the vehicle body center plane M in the width direction $D_W$. The first rear wall 23L connects the rear end of the first inner wall 21L to the rear end of the first outer wall 22L. The second rear wall 23R connects the rear end of the second inner wall 21R to the rear end of the second outer wall 22R. The bottom wall 25 connects the lower end of the first inner wall 21L to the lower end of the second inner wall 21R. The upper wall 24 connects the upper end of the first inner wall 21L and the upper end of the second inner wall 21R. The upper wall 24 faces the bottom wall 25 in the height direction $D_H$. The upper wall 24 has a first support portion 27L for rotatably supporting the rotational shaft RSL and a second support portion 27R for rotatably supporting the rotational shaft RSR.

A boom cylinder 48 for operating the first lift link 44L and the first arm 42L is provided between the first inner wall 21L and the first outer wall 22L in the width direction $D_W$. A first fulcrum shaft 46L supporting the first lift link 44L is connected to the first inner wall 21L and the first outer wall 22L. A boom cylinder 48 for operating the second lift link 44R, the second arm 42R, and the second arm 42R is provided between the second inner wall 21R and the second outer wall 22R in the width direction $D_W$. A second fulcrum shaft 46R supporting the second lift link 44R is connected to the second inner wall 21R and the first outer wall 22L.

The first track frame 28L is attached to the lower end of the first inner wall 21L through a first mounting frame 29L. The second track frame 28R is attached to the lower end of the second inner wall 21R via the second mounting frame 29R. Driven wheels 32 and 33 and a roller 34 are rotatably mounted on the first track frame 28L and the second track frame 28R. The driving wheel 31 is supported by the first inner wall 21L and the second inner wall 21R. The engine 6 is supported by the bottom wall 25 through a damper (not shown). In FIG. 4, the crankshaft $A_{XE}$ of the engine 6 is illustrated for defining the direction of the engine 6. The crankshaft $A_{XE}$ extends substantially on the vehicle body center plane M in the front-rear direction $D_{FB}$.

Figure 5:
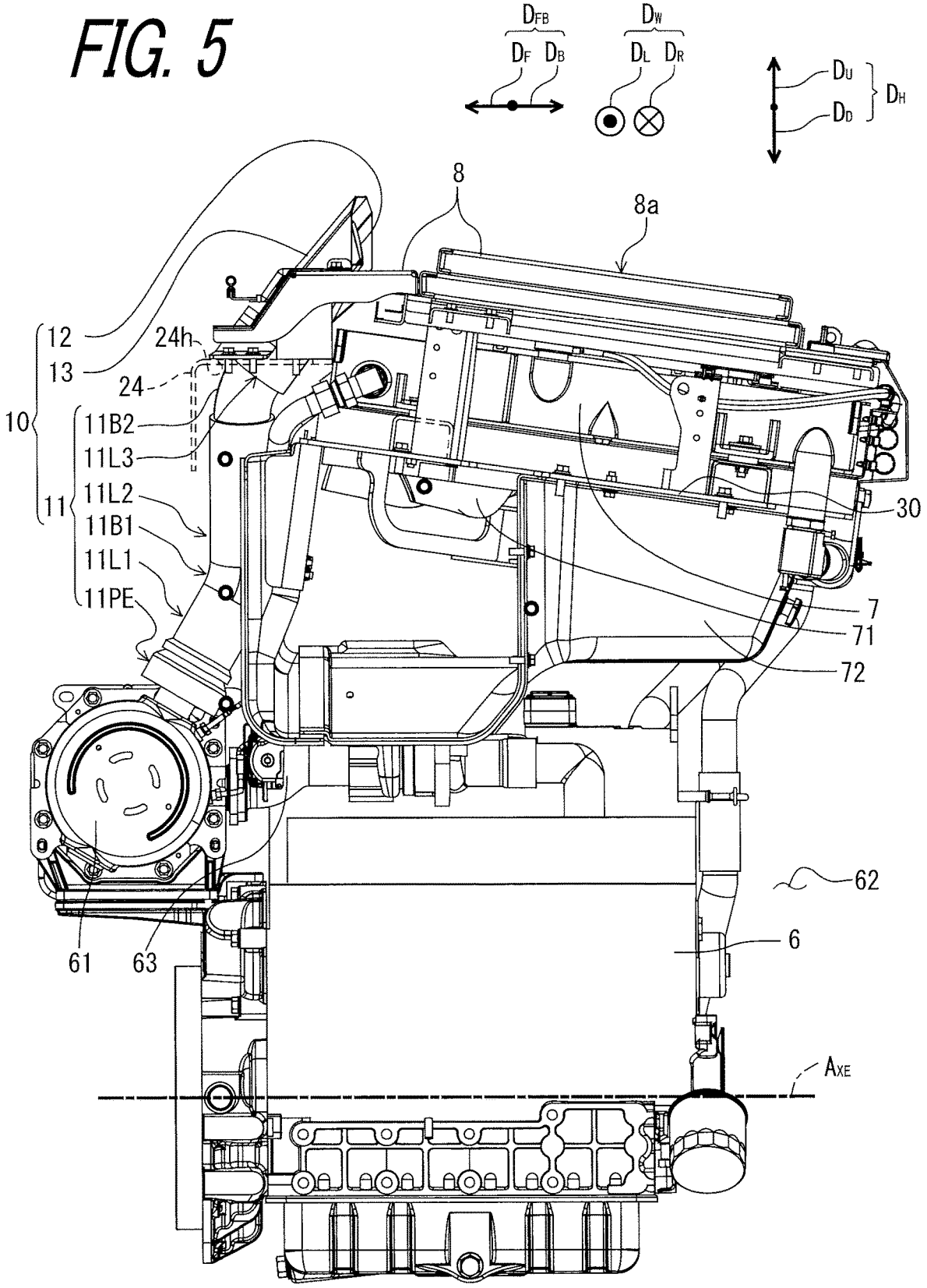
FIG. 5 is a side view of the periphery of the engine.

FIG. 5 is a side view of the periphery of the engine 6 shown in FIG. 4. In FIG. 5, the display of the vehicle body frame 2 except the upper wall 24 is omitted. The structure of the engine 6 is schematically shown, and a part of the structure of the engine 6 is not shown. As shown in FIG. 5, the heat exchanger 7, the fan 71, and the cover 8 are attached to the first inner wall 21L and the second inner wall 21R through the stay 30. The upper wall 24 is illustrated by a broken line. Referring to FIGS. 4 and 5, the upper wall 24 has an L-shaped shape bent downward at its front end. The upper wall 24 has a through hole 24*h*, and is arranged so that the exhaust pipe 11 passes through the through hole 24*h*.

Still referring to FIGS. 4 and 5, the fan 71 is located upward $D_U$ with respect to the engine. The heat exchanger 7 is located upward $D_U$ with respect to the fan 71. A cover 8 having an air suction port 8*a* is positioned upward $D_U$ with respect to the heat exchanger 7. As the fan 71 rotates, air is sent from the air suction port 8*a* to the heat exchanger 7. A fan duct 72 is provided between the fan 71 and the engine 6, and the fan duct 72 prevents air warmed by passing through the heat exchanger 7 from flowing into the engine compartment 62. The fan duct 72 also prevents outside air containing dust from flowing into the engine compartment 62. Since the fan 71 is shown in FIGS. 4 and 5, a part of the fan duct 72 is shown. However, the fan 71 is not actually exposed to the engine compartment 62 by being covered by the fan ducts 72. The engine compartment 62 is a space surrounded by the cabin 5, the fan duct 72, the first inner wall 21L, the second inner wall 21R, the bottom wall 25, and the bonnet cover 9.

Figure 6:
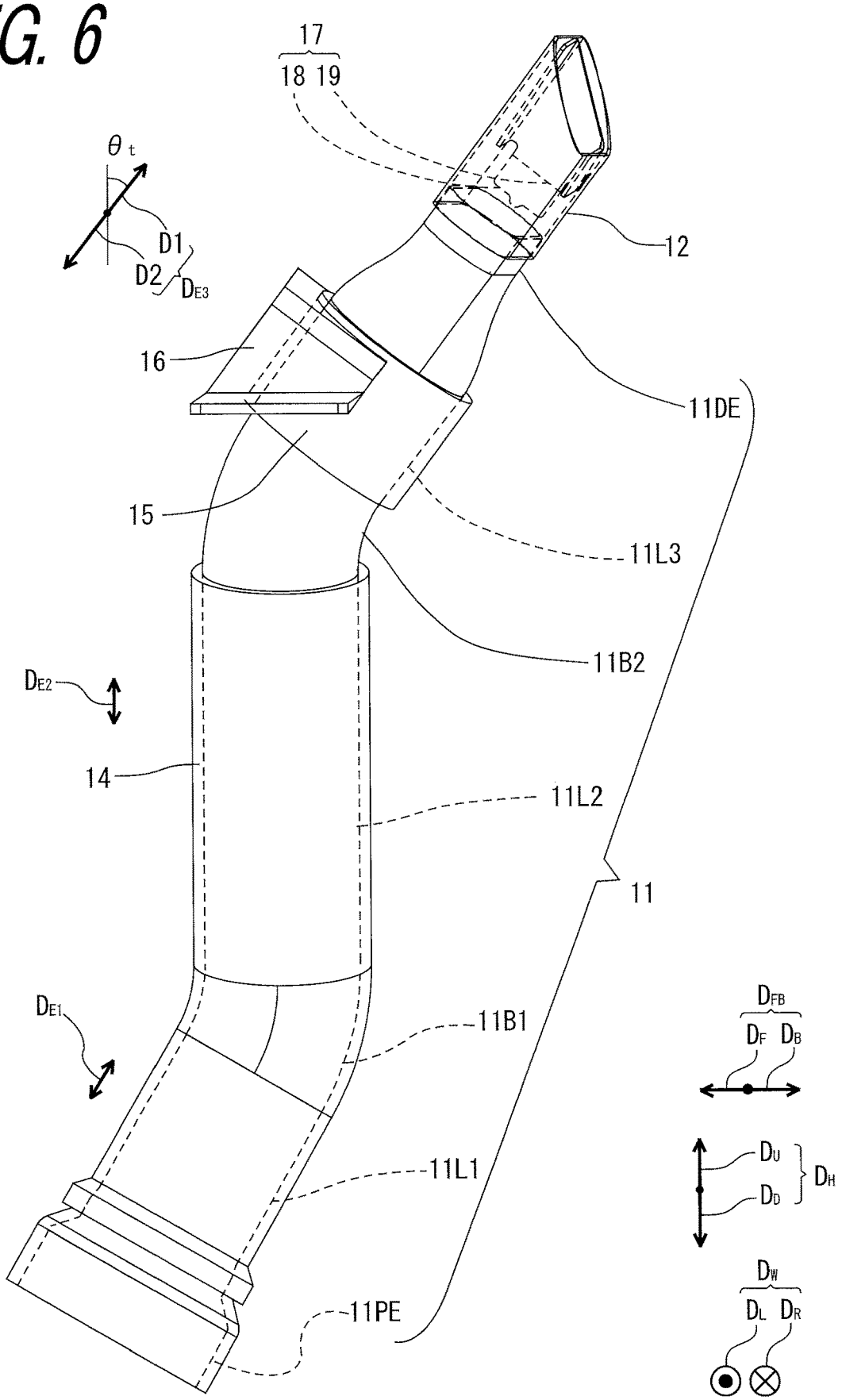
FIG. 6 is an enlarged view of the exhaust pipe and the exhaust port.

The exhaust treatment device 61 is provided in front of the engine 6 and is connected to the engine 6 by a connection pipe 63. The connection pipe 63 is connected to the right end of the exhaust treatment apparatus 61. As shown in FIG. 4, the exhaust pipe 11 is connected to the left end of the exhaust treatment apparatus 61. FIG. 6 is an enlarged view of the exhaust pipe 11 and the exhaust port 12 shown in FIG. 5. Referring to FIGS. 4-6, the exhaust pipe 11 has one end 11PE and the other end 11DE opposite end 11PE. The one end 11PE is connected to the engine 6. More specifically, the one end 11PE is connected to the engine 6 through the exhaust treatment apparatus 61 and the connection pipe 63. The exhaust pipe 11 has, in order from one end 11PE to the other end 11DE, a first linear portion 11L1, a first bent portion 11B1, a second linear portion 11L2, a second bent portion 11B2, and a third linear portion 11L3. The first linear portion 11L1, the first bent portion 11B1, the second linear portion 11L2, the second bent portion 11B2, and the third linear portion 11L3 have round pipe shapes.

The first linear portion 11L1 extends linearly in a first extending direction $D_{E1}$ inclined slightly backward from the upper $D_U$. The second linear portion 11L2 extends linearly in the second extending direction $D_{E2}$ that is inclined upward $D_U$ and leftward $D_L$ from the first extending direction $D_{E1}$. The first bent portion 11B1 connects the first linear portion 11L1 and the second linear portion 11L2, and bends toward the second extending direction $D_{E2}$. The third linear portion 11L3 extends linearly in the third extending direction $D_{E3}$ that is inclined rightward $D_R$ and backward $D_B$ from the second extending direction $D_{E2}$. The second bent portion 11B2 connects the second linear portion 11L2 and the third linear portion 11L3 and bends toward the third extending direction $D_{E3}$. The third extending direction $D_{E3}$ is not parallel to the height direction $D_H$ along the height of the work vehicle 1. In the following embodiments, of the third extending direction $D_{E3}$, which is bilateral, the direction from the second bent portion 11B2 to the other end 11DE is referred to as the first direction D1, and the direction opposite to the first direction D1 is referred to as the second direction D2. As shown in FIG. 6, the first direction D1 is tilted in the backward direction $D_B$ from the upward direction $D_U$ along the height direction $D_H$ to the rotation axis along the width direction $D_W$ by a tilt angle θt. The tilt angle θt is preferably 30 degrees or more from the viewpoint of avoiding interference with the cabin 5. As shown in FIG. 2, the first direction D1 is oriented to the left direction $D_L$ from the backward direction $D_B$ parallel to the vehicle body center plane M by a pan angle θp with respect to the rotation axis along the height direction $D_H$.

As shown in FIG. 6, a first heat insulating material 14 is wound around the first linear portion 11L1, the first bent portion 11B1, and the second linear portion 11L2. A second heat insulating material 15 is wound around the third linear portion 11L3. The mounting member 16 is fixed to the third linear portion 11L3 by press-fitting, adhesive, welding, or the like. As shown in FIGS. 4 and 5, the mounting member 16 is fixed to the upper wall 24 of the vehicle body frame 2 by bolts or the like. That is, the exhaust pipe 11 is connected to the upper wall 24 of the vehicle body frame 2.

The other end 11DE of the exhaust pipe 11 is provided with an exhaust port 12 extending in the first direction D1. At the other end 11DE, the shape of the pipe is changed from a round pipe to an elongated hole pipe so as to correspond to the shape of the exhaust port 12. An exhaust port 12 is inserted into the other end 11DE. The exhaust port 12 is fixed to the exhaust pipe 11 by press-fitting, adhesive, welding, or the like. As shown in FIGS. 4 and 5, the exhaust port 12 is protected by being covered with an exterior cover 13. That is, the exhaust mechanism 10 includes the exterior cover 13. The exterior cover 13 is fixed to the cover 8 by bolts or the like. As shown in FIGS. 2 and 5, the exhaust port 12 faces the air suction port 8*a*.

Figure 7:
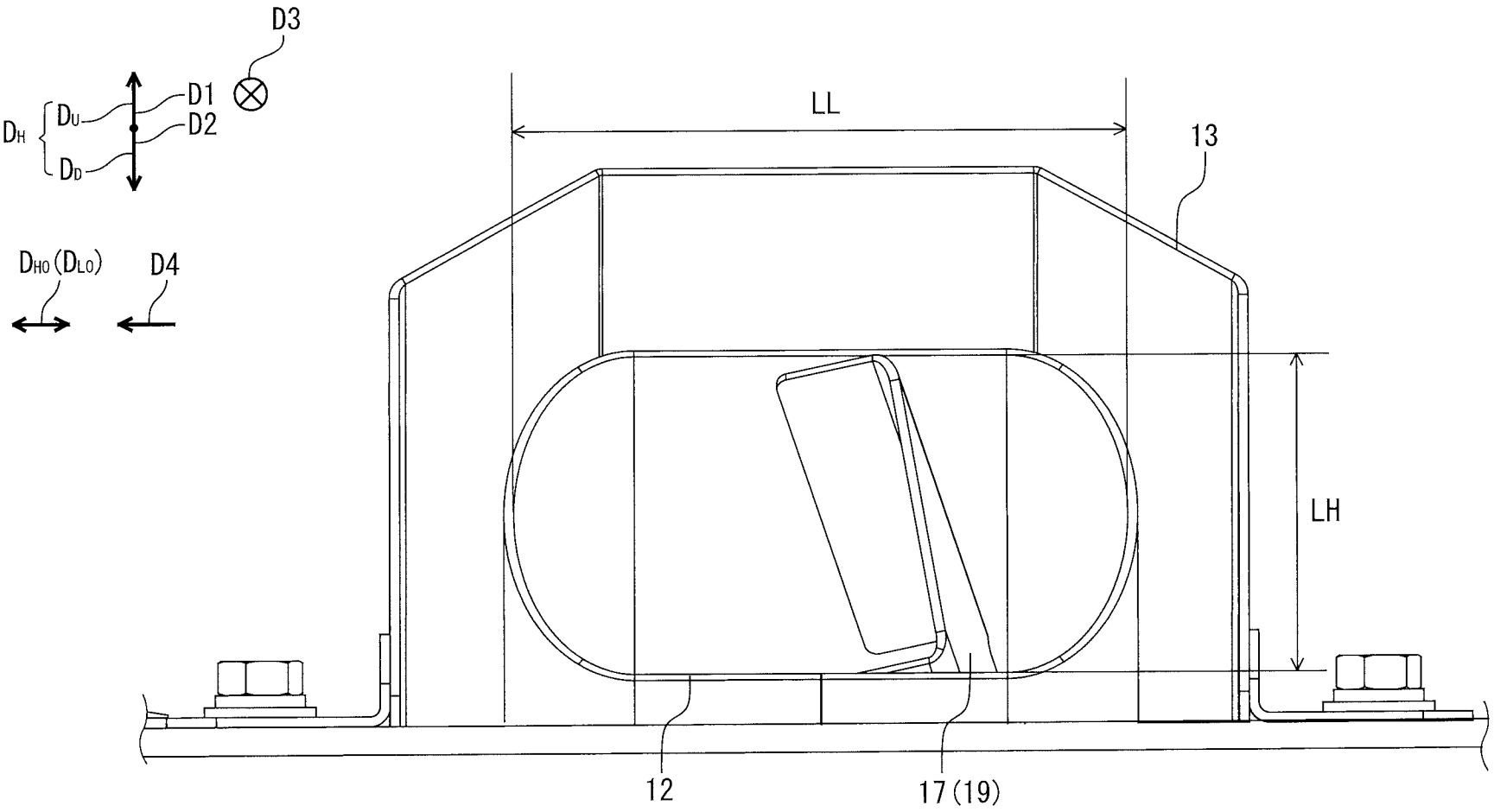
FIG. 7 is an enlarged view of the exhaust port.
Figure 8:
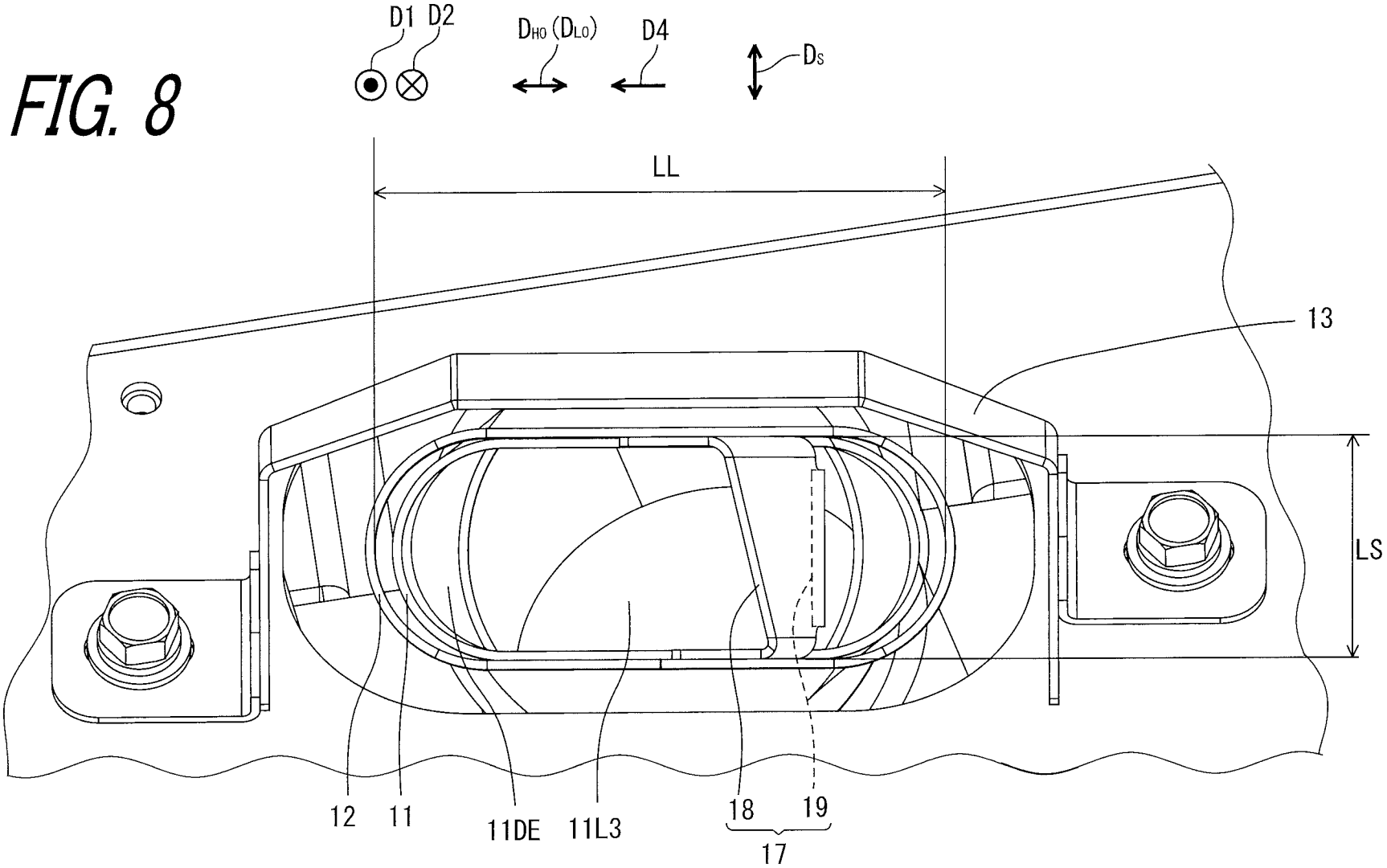
FIG. 8 is a view showing the internal shape of the exhaust port and the exhaust pipe.

FIG. 7 is an enlarged view of the exhaust port 12 and the exterior cover 13 when viewed from the third direction D3 obtained by projecting the second direction D2 on a plane perpendicular to the height direction $D_H$. Referring to FIG. 7 and the like, the exhaust port 12 has an elongated hole pipe shape. The length LH of the exhaust port 12 in the height direction $D_H$ is shorter than the length LL of the exhaust port 12 in the transverse direction (horizontal direction) $D_{HO}$ perpendicular to a plane including the first direction D1 and the height direction $D_H$. In the present embodiment, a longitudinal direction $D_{LO}$ along the long axis of the elongated hole coincides with the transverse direction $D_{HO}$. FIG. 8 shows the internal shapes of the exhaust port 12 and the exhaust pipe 11 as viewed in the second direction D2. Referring to FIG. 8, the length LL of the exhaust port 12 in the longitudinal direction $D_{LO}$ (the transverse direction $D_{HO}$) is longer than the length LS of the exhaust port 12 in the lateral direction $D_S$ perpendicular to a plane including the first direction D1 and the longitudinal direction $D_{LO}$. The length LS is shorter than the length LL described above.

Figure 9:
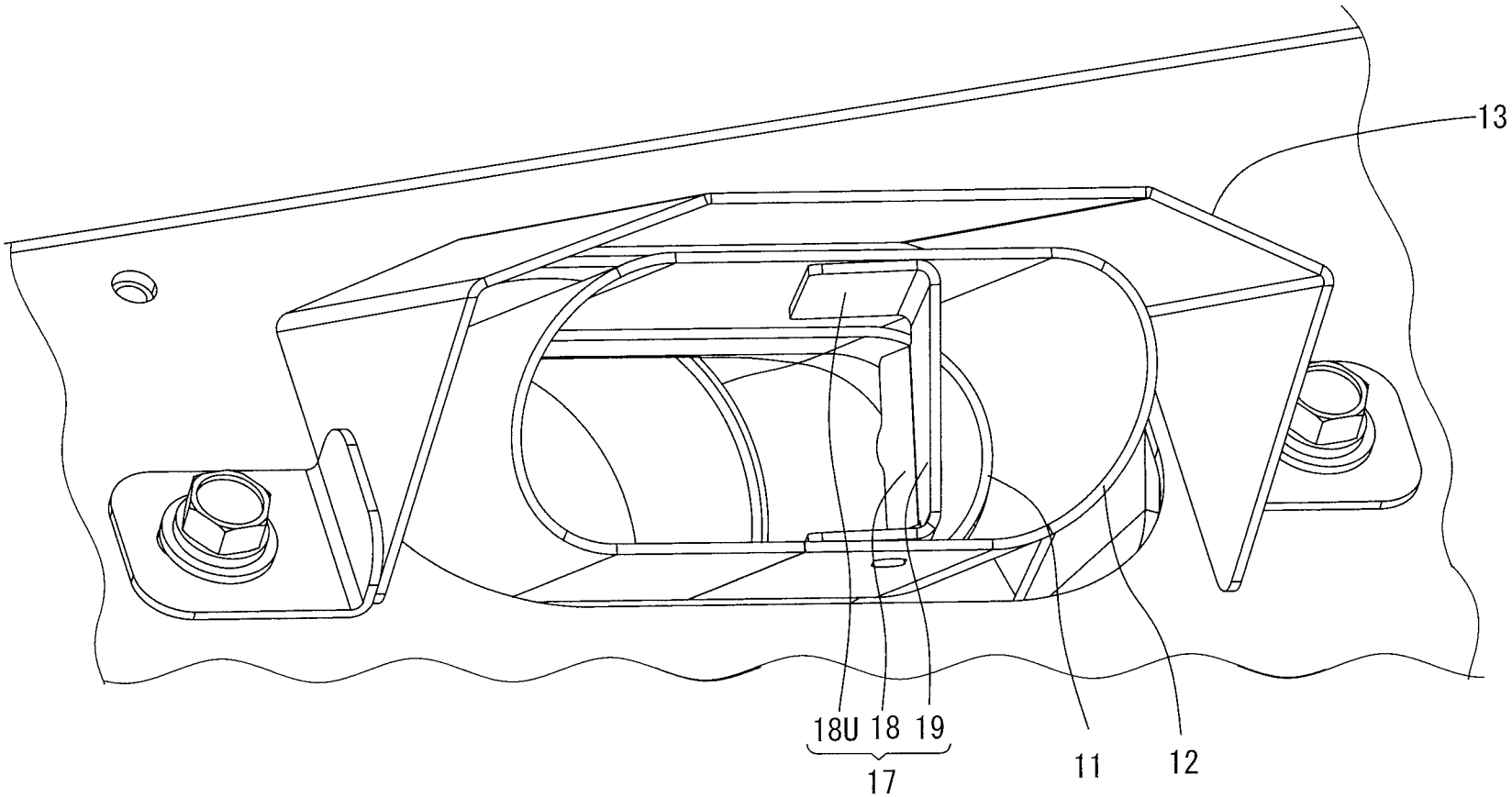
FIG. 9 shows the internal shape of the exhaust port and the exhaust pipe.
Figure 10:
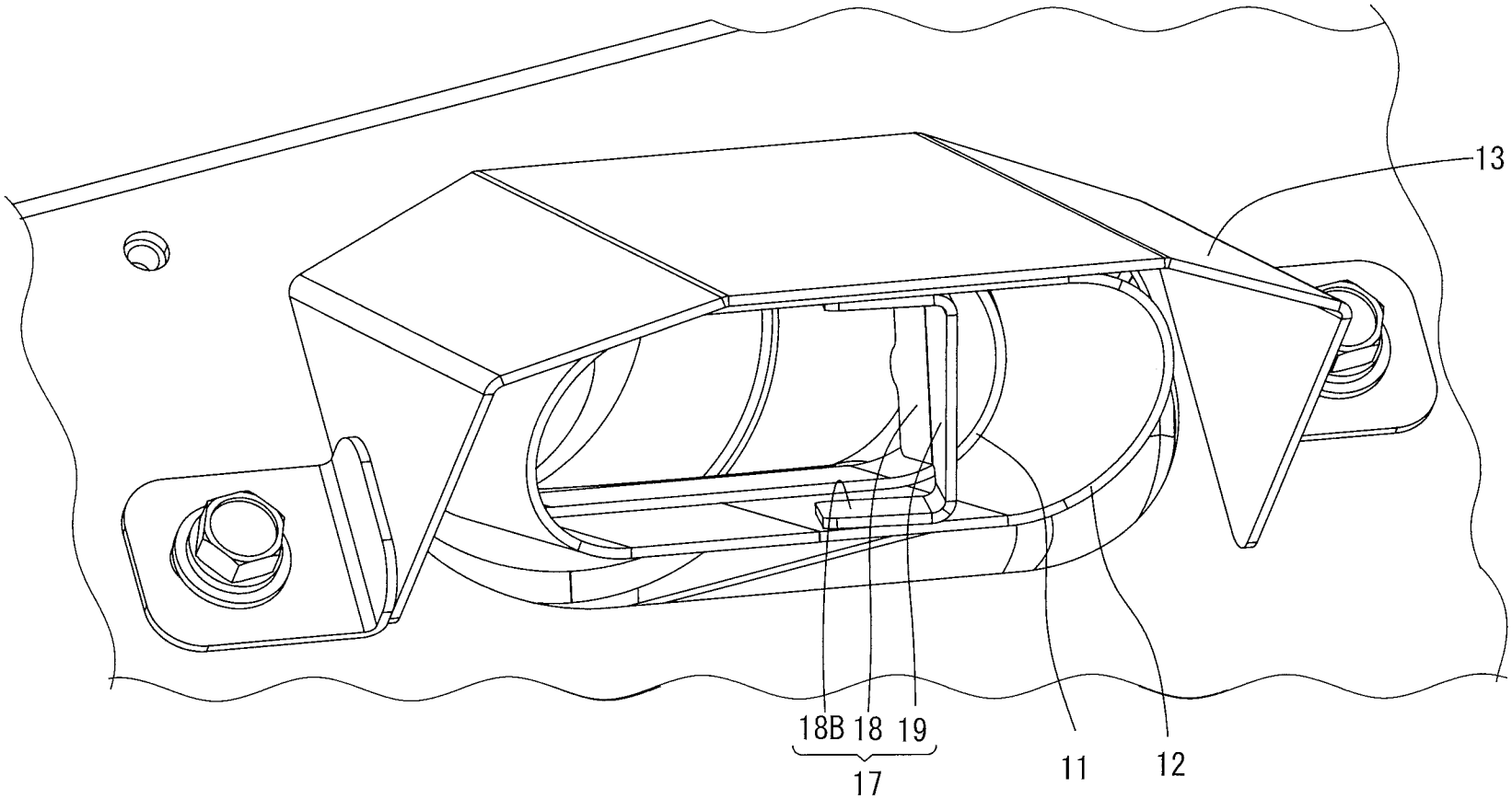
FIG. 10 shows the internal shape of the exhaust port and the exhaust pipe.

FIG. 9 is a view showing the internal shapes of the exhaust port 12 and the exhaust pipe 11 as viewed in a sight direction oriented leftward and downward from the second direction D2. The sight direction in FIG. 9 is along a direction in which the second direction D2 is rotated, as viewed downward, clockwise around a rotational axis extending in the height direction $D_H$ and is rotated, as viewed leftward direction, counterclockwise around a rotational axis perpendicular to the second direction D2. FIG. 10 is a view showing the internal shapes of the exhaust port 12 and the exhaust pipe 11 as viewed in a sight direction oriented leftward and upward from the second direction D2. The sight direction in FIG. 10 is along a direction in which the second direction D2 is rotated, as viewed downward, clockwise around a rotational axis extending in the height direction $D_H$ and is rotated, as viewed leftward, clockwise around a rotational axis perpendicular to the second direction D2.

Referring to FIGS. 6 to 10, the exhaust port 12 includes a baffle plate 17 for changing the exhaust direction from the first direction D1 to the longitudinal direction $D_{LO}$ (the transverse direction $D_{HO}$). Specifically, the baffle plate 17 is configured to change the exhaust direction from the first direction D1 to a fourth direction D4 which is away from the vehicle body center plane M, out of the longitudinal direction $D_{LO}$, which is bilateral (the transverse direction $D_{HO}$). Referring to FIG. 6, the baffle plate 17 is provided inside the exhaust port 12. The baffle plate 17 has a proximal end portion 18 and a distal end portion 19. The proximal end portion 18 is adjacent to the exhaust pipe 11 and extends in the first direction D1. Specifically, the surface of the proximal end portion 18 is substantially parallel to the first direction D1. The distal end portion 19 is connected to the proximal end portion 18 and is located further from the exhaust pipe 11 than the proximal end portion 18. That is, the proximal end portion 18 is located between the distal end portion 19 and the other end 11DE of the exhaust pipe 11 in the third extending direction $D_{E3}$. The end portion 19 extends in a fifth direction D5 inclined from the first direction D1 toward the longitudinal direction $D_{LO}$ (the transverse direction $D_{HO}$). More specifically, the distal end portion 19 extends in a fifth direction D5 inclined from the first direction D1 toward the fourth direction D4.

Referring to FIGS. 9 and 10, the baffle plate 17 further includes an upper attachment portion 18U and a lower attachment portion 18B which are connected to the distal end portion 19. The upper attachment portion 18U and the lower attachment portion 18B are respectively fixed to the upper inner wall and the lower inner wall of the exhaust port 12 by press-fitting, adhesive, welding, or the like. The proximal end portion 18, the distal end portion 19, the upper attachment portion 18U, and the lower attachment portion 18B are formed by bending one plate. The distal end portion 19, the upper attachment portion 18U and the lower attachment portion 18B are bent in a substantially U-shape. The proximal end portion 18 is bent from the distal end portion 19 such that the angle between the proximal end portion 18 and the distal end portion 19 is less than 170 degrees.

FIG. 2 shows a virtual straight line VL1 connected to the surface of the proximal end portion 18 and projecting the first direction D1 onto a projection plane perpendicular to the height direction $D_H$, a virtual straight line VL2 connected to the surface of the distal end portion 19 and projecting the fourth direction D4 onto the projection plane, and a virtual straight line VL0 passing through the intersection of the virtual straight line VL1 and the virtual straight line VL2 and extending in the front-rear direction $D_{FB}$. Since the proximal end portion 18 extends in the first direction D1, the virtual straight line VL1 extends in a direction in which the first direction D1 is projected on the projection plane. Since the distal end portion 19 extends in the fifth direction D5, the virtual straight line VL2 extends in a direction in which the fifth direction D5 is projected on the projection plane. With reference to these, when viewed from the height direction $D_H$, the angle $\alpha$ formed by the front-rear direction $D_{FB}$ and the distal end portion 19 is larger than the angle $\theta p$ formed by the front-rear direction $D_{FB}$ and the proximal end portion 18. When viewed from the height direction $D_H$, the angle $\theta p$ made by the backward direction $D_B$ and the first direction D1 is less than 15 degrees. When viewed from the height direction $D_H$, the angle $\beta$ between the proximal end portion 18 and the distal end portion 19 is less than 170 degrees. Thus, when viewed from the height direction $D_H$, the angle $\alpha$ between the backward direction $D_B$ and the fifth direction D5 can be set to 20 degrees or more.

<Operation and Effect of Embodiments>

Referring to FIGS. 1 and 2, in the work vehicle 1 according to the present embodiment, since the heat exchanger 7 is disposed above the engine 6, the exhaust mechanism 10 is disposed higher than the rotational axis $A_{XC}$ of the cabin 5. However, even in such a case, since the length LH of the exhaust port 12 in the height direction $D_H$ is shorter than the length LL of the exhaust port 12 in the transverse direction $D_{HO}$, and the angle $\theta p$ made by the backward direction $D_B$ and the first direction D1 is less than 15 degrees, interference with the cabin 5 that is capable of opening and closing can be avoided. In this case, since the first direction D1 is directed to the air suction port 8*a* located in the upper space of the engine compartment 62, there is a possibility that a large amount of high-temperature exhaust is sent to the heat exchanger 7 to lower the cooling efficiency, but exhaust to the upper space of the engine compartment 62 can be suppressed by changing the exhaust direction to the side of the work vehicle 1 (fifth direction D5) by the baffle plate 17. As a result, the amount of exhaust toward the air suction port 8*a* can be reduced, and the lowering of the cooling efficiency of the heat exchanger 7 can be suppressed.

In a work vehicle such as Japanese Patent No. 6400520, it is necessary to determine the position and direction of the exhaust port so as not to interfere with the opening/closing cabin, but in the exhaust mechanism that is long in the height direction of the work vehicle disclosed in Japanese Patent Laid-Open No. 2010-248691, the exhaust port interferes with the open/close cabin and exhaust gas is discharged toward an upper space of the engine room. Further, in the exhaust mechanism of Japanese Patent No. 6400520, in order to limit exhaust gas discharged into the space above the engine compartment, the exhaust port is largely turned from the rear to the side and the exhaust gas is discharged through the exhaust port, but it is necessary to provide the exhaust port low with respect to the rotation shaft of the cabin so as not to interfere with the cabin in the open state.

An object of the present invention is to provide an exhaust mechanism capable of suppressing exhaust to an upper space of an engine compartment while avoiding interference with an opening/closing cabin even when an exhaust port is arranged high with respect to a rotation axis of the cabin.

An exhaust mechanism for a work vehicle according to one aspect of the present disclosure includes an exhaust pipe and an exhaust port. The exhaust pipe has one end and another end opposite to the one end, and the one end is connected to the engine. The exhaust port is provided at another end of the exhaust pipe and extends in a first direction non-parallel to the height direction along a height of the work vehicle. A length of the exhaust port in the height direction is shorter than a length of the exhaust port in the transverse direction perpendicular to a plane including the first direction and the height direction. The exhaust port is provided with a baffle plate for changing an exhaust direction from the first direction to the transverse direction.

A work vehicle according to another aspect of the present disclosure includes an exhaust mechanism according to the first aspect, a heat exchanger for cooling a refrigerant, a cover for covering the heat exchanger, an air suction port provided on the upper surface of the cover, and a fan for sending air from the air suction port to the heat exchanger. The exhaust port faces the air suction port.

According to the technique disclosed in the present application, for example, it is possible to provide an exhaust mechanism capable of suppressing exhaust to an upper space of an engine compartment while avoiding interference with an opening/closing cabin.

<Variations of the Embodiments>

Although the embodiments described above show the exhaust port 12 having a shape such that the longitudinal direction $D_{LO}$ along the longitudinal axis of the elongated hole coincides with the transverse direction $D_{HO}$, the longitudinal axis of the elongated hole may be inclined with respect to the transverse direction $D_{HO}$ as long as the length LH is shorter than the length LL. In this case, the fourth direction D4 in which the distal end portion 19 is inclined is not parallel to the transverse direction $D_{HO}$, but if the fourth direction D4 contains a vector component of the transverse direction $D_{HO}$, the distal end portion 19 may be interpreted as extending from the first direction D1 to the transverse direction $D_{HO}$.

Further, in the present embodiment, the shape, bending direction, and extending direction of the exhaust pipe 11 are arbitrary and may be appropriately changed according to the internal structure of the engine compartment 62. In the baffle plate 17, the proximal end portion 18 can be omitted. Further, the angle $\alpha$ formed by the front-rear direction $D_{FB}$ and the distal end portion 19 can be appropriately changed within a range in which a backflow in the exhaust direction does not occur, or within a range in which an excessive exhaust resistance that lowers the performance of the engine 6 does not occur. In the embodiment described above, there is only one baffle plate 17, but the exhaust mechanism 10 (exhaust port 12) may have a plurality of baffle plates 17. The hole of the exhaust port 12 may be a polygonal hole rather than an elongated hole. The hole of the exhaust port 12 may become larger as it is further away from the other end 11DE of the exhaust pipe 11.

As used herein, "comprise" and its derivatives are non-limiting terms that describe the presence of a component and do not exclude the presence of other components that are not described. This also applies to "have", "include" and their derivatives.

The terms " . . . members", " . . . portion", " . . . element", " . . . body" and " . . . structure" may have multiple meanings, such as a single part or multiple parts.

Ordinal numbers such as "first" and "second" are terms used only to identify structures and do not have other meanings (for example, in a particular order). For example, the existence of "first element" does not imply the existence of "second element" and the existence of "second element" does not imply the existence of "first element".

Terms such as "substantially", "roughly", and "about", which represent degrees, may mean a reasonable amount of deviation such that the final result does not vary significantly unless otherwise explained in the embodiments. All figures described herein may be interpreted to include phrases such as "substantially", "roughly", "about", and the like.

The phrase "at least one of A and B" in this application should be interpreted to include only A, only B, and both A and B.

It will be apparent from the above disclosure that various modifications and modifications of the present invention are possible. Accordingly, the present invention may be practiced in a manner different from the specific disclosure of the present invention without departing from the spirit and spirit of the invention.

Obviously, numerous modifications and variations of the present invention are possible in light of the above teachings. It is therefore to be understood that within the scope of the appended claims, the invention may be practiced otherwise than as specifically described herein.

What is claimed is:

1. An exhaust mechanism for a work vehicle, comprising:

an exhaust pipe having one end connected to an engine and another end opposite to the one end along a length of the exhaust pipe;

an exhaust port provided at the another end of the exhaust pipe and extending in a first direction inclined from a height direction along a height of the work vehicle, a length of the exhaust port in the height direction being shorter than a length of the exhaust port in a transverse direction perpendicular to a plane including the first direction and the height direction; and a baffle plate provided in the exhaust port and configured to change an exhaust gas flow from the first direction to the transverse direction.

2. The exhaust mechanism according to claim 1, wherein the baffle plate comprises:

a proximal end portion adjacent to the exhaust pipe; and a distal end portion connected to the proximal end portion and provided further away from the exhaust pipe than the proximal end portion, the proximal end portion extends in parallel to the first direction, and the distal end portion extends in an inclined direction from the first direction toward the transverse direction.

3. The exhaust mechanism according to claim 1, wherein the exhaust pipe is connected to an upper wall of a vehicle body frame of the work vehicle.

4. A work vehicle comprising:

an exhaust mechanism according to claim 2;

a heat exchanger to cool a refrigerant;

a cover covering the heat exchanger;

an air suction port provided on an upper surface of the cover; and a fan to send air from the air suction port to the heat exchanger, the exhaust port facing the air suction port.

5. The work vehicle according to claim 4, further comprising:

a vehicle body frame; and a cab frame rotatable about a rotational shaft on the vehicle body frame, the exhaust mechanism being provided between the rotational shaft and the air suction port in a front-rear direction of the vehicle body frame.

6. The work vehicle according to claim 5, wherein an angle formed by the front-rear direction and the distal end portion is larger than an angle formed by the front-rear direction and the proximal end portion when viewed from the height direction.

7. The work vehicle according to claim 6, wherein an angle formed by a rearward direction and the first direction when viewed from the height direction is less than 15 degrees.

8. The work vehicle according to claim 7, wherein an angle formed by the proximal end portion and the distal end portion when viewed in the height direction is less than 170 degrees.

* * * * *